United States Patent [19]

Warren

[11] Patent Number: 4,925,417

[45] Date of Patent: May 15, 1990

[54] UNDERWATER VIEWING PADDLE BOARD

[76] Inventor: John R. Warren, 721 NW. 49th, Oklahoma City, Okla. 73118

[21] Appl. No.: 247,687

[22] Filed: Sep. 22, 1988

[51] Int. Cl.[5] ..... B63B 35/00

[52] U.S. Cl. ..... 441/65; 441/135; 114/66

[58] Field of Search ..... 441/65, 74, 135; 114/66, 315

[56] References Cited

U.S. PATENT DOCUMENTS

| | | | |
|---|---|---|---|
| D. 175,764 | 10/1955 | Dotson | D71/1 |
| D. 189,273 | 11/1960 | Saeman | D71/1 |
| D. 221,697 | 8/1971 | Nicholson | D71/1 |
| D. 233,904 | 12/1974 | Dage | D34/42 |
| 2,712,139 | 7/1955 | Kelly | 9/21 |
| 2,717,399 | 9/1955 | Backhouse | 9/21 |
| 3,042,945 | 7/1962 | Saeman | 9/310 |
| 3,085,356 | 4/1963 | Wayfield | 35/29 |
| 3,921,239 | 11/1975 | Sovia et al. | 441/65 |
| 4,691,658 | 9/1987 | New et al. | 114/66 |

FOREIGN PATENT DOCUMENTS

| | | | |
|---|---|---|---|
| 1171591 | 11/1969 | United Kingdom | 441/135 |
| 2165186 | 4/1986 | United Kingdom | 441/135 |
| 2188881 | 10/1987 | United Kingdom | 441/135 |

*Primary Examiner*—Sherman D. Basinger
*Assistant Examiner*—Stephen P. Avila
*Attorney, Agent, or Firm*—Laney, Dougherty, Hessin & Beavers

[57] ABSTRACT

An apparatus for underwater surveillance that consists of a floating platform having bow and stern with an aerodynamically true forward cowl formed on the bow end, the forward approximately one-third of the platform. Immediately aft of the cowl there is disposed a viewing assembly placed in a clearance formed centrally through the platform, and the viewing assembly is a tightly sealed transparent member having top panel, bottom panel and side panel and defining a volume that is maintained liquid free thereby to enable maximum viewing efficiency at all times.

8 Claims, 2 Drawing Sheets

UNDERWATER VIEWING PADDLE BOARD

BACKGROUND OF THE INVENTION

1. Field of the Invention.

The present invention relates to a paddle board of generally unitary construction that includes cowling and body accommodation structure and has a sealed viewing assembly disposed through the paddle board to enable subsurface viewing.

2. Description of the Prior Art.

There have been a number of prior teachings that relate to the basic structure of a surfboard or other mini-float vessel having see-through capability. An early U.S. Pat. No. 2,712,139 in the name of Kelly teaches a generally rectangular float that includes a viewing well therethrough. The viewing structure consists of a sleeve member for insertion within the viewing well while rigidly supporting a planar viewing window in optical communication with the subsurface. Similar structure is taught by U.S. Pat. No. 2,717,399 as employed with inflatable float structure.

U.S. Pat. Nos. 3,042,945 and 4,691,658 each teach a form of float device with a viewing window wherein the window consists of a double pane arrangement with top and bottom transparent panels that are secured into the viewing sled or float. This type of design provides an attempt at sealing structure albeit that the viewing structure is subject to leakage and fogging especially as may occur with any longitudinal flexure of the float structure. Additional prior art found to be of general interest is submitted by Information Disclosure filed concurrently herewith.

SUMMARY OF THE INVENTION

The present invention is a see-through paddle board construction that allows comfortable, clear viewing of the subsurface while still retaining optimum paddle board capabilities of maneuverability and comfort. The paddle board consists of an elongated float platform having a bow and stern with a cowl formed adjacent the bow end that ascends rearwardly to a viewing position while the remainder of the platform, the major portion, is formed as a longitudinally oriented concave decking. A sealed, hollow viewing assembly is positioned in sealed disposition through the platform immediately rearward of the cowl portion, and the rearward vertical surfaces of the cowl portion are ideally formed to provide both a body brace or rest structure and a form-fitting face rest when in viewing attitude.

Therefore, it is an object of the present invention to provide a lightweight paddle board that includes subsurface viewing capability.

It is also an object of the present invention to provide a paddle board of functional design that retains attributes of portability and ruggedness.

It is still further an object of the invention to provide a paddle board with an underwater viewing assembly that is free from blurring and fogging due to water interference.

Finally, it is an object of the invention to provide a sealed, underwater viewing assembly for insertion in a paddle board.

Other objects and advantages of the invention will be evident from the following detailed description when read in conjunction with the accompanying drawings which illustrate the invention.

DETAILED DESCRIPTION OF THE INVENTION

Figure 1:
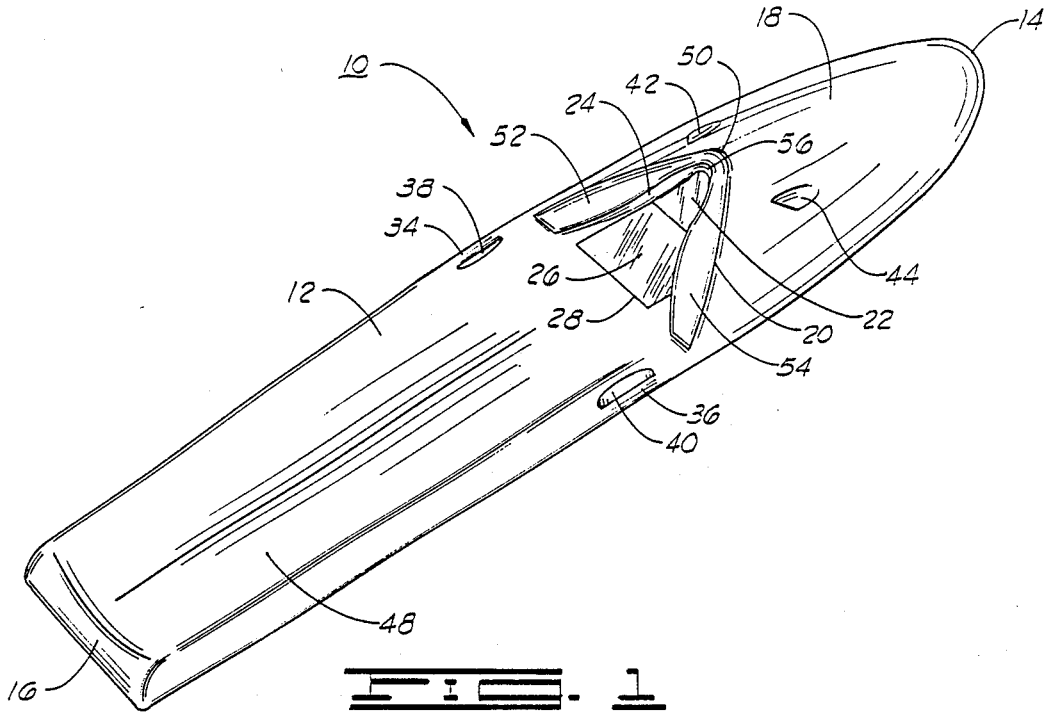
FIG. 1 is a perspective view from the rear, upper quarter of a viewing paddle board constructed in accordance with the present invention.
Figure 2:
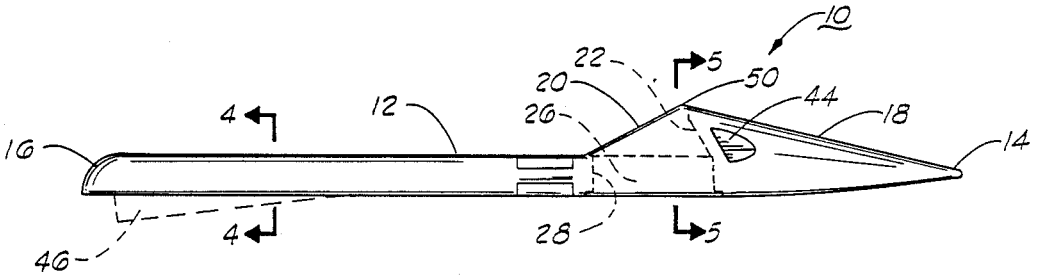
FIG. 2 is a side view in elevation of the paddle board.

Referring to FIGS. 1 and 2, a paddle board 10 consists of an elongated, platform 12, having a bow end 14 and a stern end 16. The platform 12 is streamline formed with minimal abrupt changes of line as it defines a forward cowl portion 18 that ascends rearwardly from bow 14 about one-third of the way rearward on platform 12 to terminate in a forward angled arch surface 20.

The cowl portion 18 is formed with a rear wall 22 disposed forward and beneath the arch surface 20 as an arcuate interior wall 24 forms an interior volume immediately surrounding a viewing assembly 26. The assembly 26 is suitably secured through a similarly sized hole or centrally disposed clearance 28.

Figure 3:
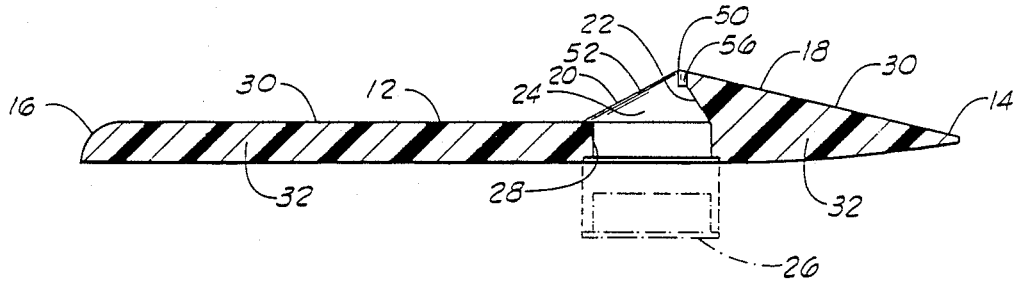
FIG. 3 is a vertical section taken centrally longitudinally of the paddle board as shown in FIG. 2.
Figure 4:
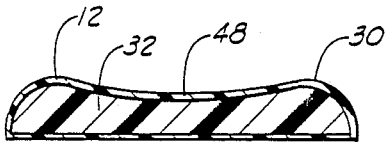
FIG. 4 is a cross-section taken along lines 4—4 of FIG. 2.
Figure 5:
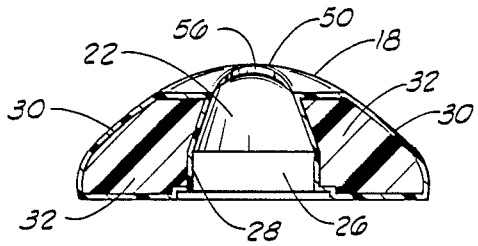
FIG. 5 is a cross-section taken along lines 5—5 of FIG. 2.

Referring also to FIGS. 3, 4 and 5, the platform 12 is constructed of a hard, continuous outer shell 30 that is filled with a suitable flotation material such as plastic foam core 32. In present practice, the outer shell 12 is rotationally molded from polyethylene while a closed cell polyurethane foam constitutes core 32. Molded-in features include opposite side, midbody handles 34 and 36 which define 2×6 inch hand holes 38 and 40. Also, forward indentations or finger grips 42 and 44, port and starboard respectively, provide a stabilizing grip for the viewer.

The bottom of shell 12 is shown as a flat surface although one or more longitudinal drift fins or skegs 46 may be included to provide additional pointing stability. The upper side of the rear portion of platform 12 is formed as a concave surface 48 to provide comfortable, secure body positioning. The cowl 18 is formed in streamlined, rearwardly ascending fashion terminating in a central raised point 50 as the arch surface 20 is formed laterally into respective port and starboard sidewall surfaces 52 and 54. The surfaces 52 and 54 narrow at the top approaching peak 50 and a semi-circular cutout 56 provides a forehead support during viewing.

Figure 6:
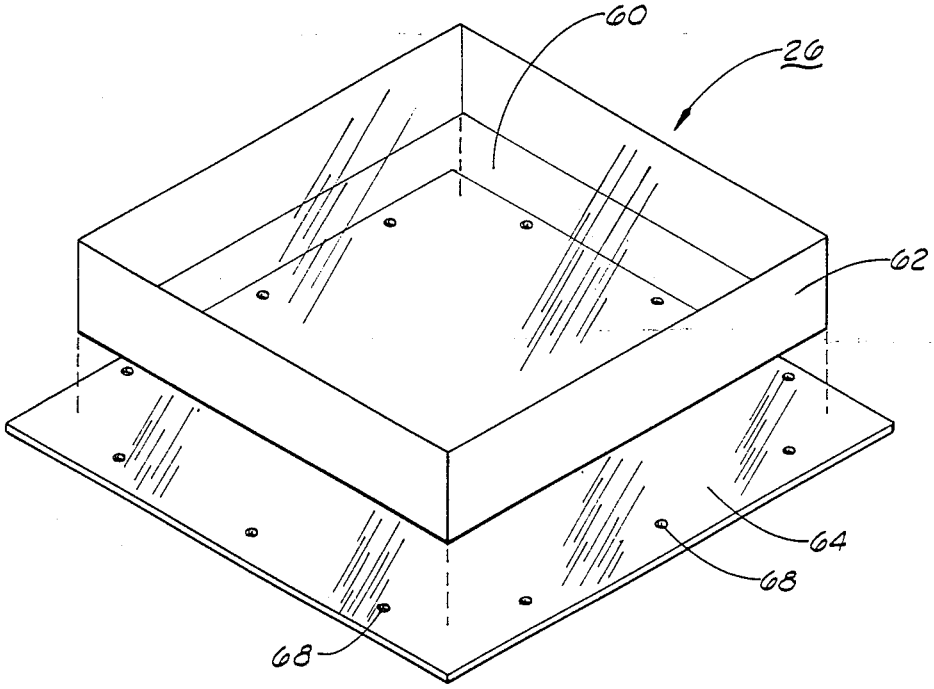
FIG. 6 is a perspective view of the viewing assembly in exploded form.
Figure 7:
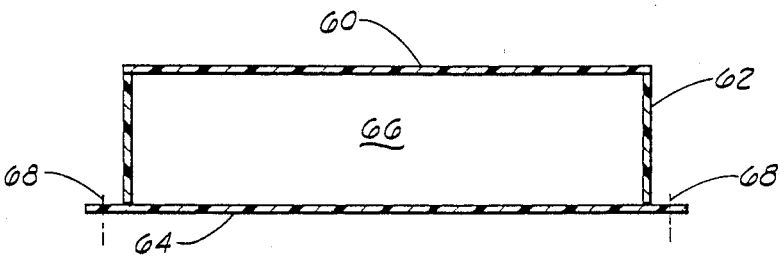
FIG. 7 is a vertical cross-section of the viewing assembly.

Referring to FIGS. 6 and 7, the viewing assembly 26 is formed from a clear plastic material as a sealed enclosure consisting of a top panel 60, side panel 62 and bottom panel 64. The side panel 62 is shown as a four-sided enclosure but this may be varied as a number of different shapes or multi-sided configurations may be utilized. The paneling of viewing assembly 26 may be formed of such as clear acrylic plastic; however, there are various forms of clear plastic that may give suitable performance.

The side wall 62 and top panel 60 are preferably molded into a unitary form in continuous, sealed joinder. The lower panel 64 is then suitably joined with bonding compound in tightly sealed relationship. If desired, the interior of viewing assembly 26 may be hermetically sealed to further assure visual clarity. A suitable solvent for use in joining acrylic paneling consists of a three component mixture of (1) methylene chloride, (2) trichloroethylene, and (3) methylmethacrylate monomer. Thus, such bonding of bottom panel 64 peripherally around side panel 62 results in a tightly sealed volume 66 that insures continual clear viewing of the underwater environs. The viewing assembly 26 is inserted upward within clearance 28, and it may be secured by suitable fasteners through peripheral holes 68.

In operation, the float 12 may be readily paddled by hand as the user lies prone on concave portion 48 allowing paddling arm motion on each side of float 12. The user can place his forehead in the cut-out 56, a smooth fit, while both maneuvering and paddling the float 12 and viewing downward through viewing assembly 26 to effect surveillance of the water and marine life therebelow. The indented hand-holds 42 and 44 may be utilized for view positioning of the upper body. Alternatively, the user can use float 12 in a manner whereby he is seated with his back toward sidewall surfaces 52 and 54 thereby to provide a back support while paddling the float 12. Still further, the user may employ a kayak paddle or other oar implement for propulsion while seated in the semi-upright position with back resting at descending arch surface 20.

The user may view through the viewing assembly 26, a clear air volume, and have continual, unobstructed viewing. The sealed viewing assembly 26 alleviates the possibility of water or condensate entering or forming within the volume 66. Even with longitudinal flexure and other stress bending of the platform 12, the viewing assembly 26 remains a sealed, unstressed component that enables continual clear viewing therethrough. The cowl 18 and snug-fitting forehead indentation 56 cooperate to keep water off of the top surface of viewing assembly 26 as shoulder contact with sidewall surfaces 52 and 54 prevents entry of water from the side.

The foregoing discloses a novel form of underwater surveillance float in the form of a streamlined paddle board having desirable features of maneuverability while also providing a sealed viewing assembly that maintains a clear subsurface view. The viewing assembly is a sealed unit and not subject to the stress and bending of the overall float member so that it can maintain the clear viewing relationship without danger of leakage.

Changes may be made in combination and arrangement of elements as heretofore set forth in the specification and shown in the drawings; it being understood that changes may be made in the embodiments disclosed without departing from the spirit and scope of the invention as defined in the following claims.

What is claimed is:

1. A substrate viewing paddle board comprising:

a platform of elongated shape and positive buoyancy having bow and stern ends with the bow end formed to include a rearwardly ascending cowl portion that terminates approximately one-third of the length toward the stern in a forward angled arch surface that extends over a rear wall transverse to the platform thereby to define an arcuate interior wall;

a central clearance of generally equi-dimensional shape formed vertically through the platform immediately rearward of the rear wall and generally within said arcuate interior wall and centrally in said platform; and a viewing assembly of similar equi-dimensional shape retained within said central clearance, said viewing assembly being a sealed transparent volume having generally parallel top and bottom panels and continuous side panel.

2. A paddle board as set forth in claim 1 which is further characterized in that:

said cowl portion angled arch surface defines port and starboard sidewall surfaces defining an interior volume having front and sides that enclose over the central clearance and viewing assembly.

3. A paddle board as set forth in claim 2 which is further characterized in that:

said arch surface includes a rearward opening arcuate cutout in the arch surface to accommodate the users forehead further to isolate the viewing assembly.

4. A paddle board as set forth in claim 1 wherein said viewing assembly comprises:

a unitarily molded top viewing panel and sidewall formed of clear plastic; and a bottom viewing panel disposed generally parallel to said top viewing panel and bonded to said sidewall to form a sealed, fluid-tight volume.

5. A paddle board as set forth in claim 4 wherein:

said top and bottom viewing panels and sidewall are formed of clear acrylic plastic.

6. A paddle board as set forth in claim 1 wherein said platform further comprises:

a unitary, thin outer plastic shell forming all exterior surfaces including the central clearance while defining a void; and cellular foam plastic disposed to fill said void.

7. A paddle board as set forth in claim 2 wherein said platform further comprises:

a unitary, thin outer plastic shell forming all exterior surfaces including the central clearance while defining a void; and cellular foam plastic disposed to fill said void.

8. A paddle board as set forth in claim 4 wherein said platform further comprises:

a unitary, thin outer plastic shell forming all exterior surfaces including the central clearance while defining a void; and cellular foam plastic disposed to fill said void.

* * * * *

UNITED STATES PATENT AND TRADEMARK OFFICE

CERTIFICATE OF CORRECTION

PATENT NO. : 4,925,417

DATED : May 15, 1990

INVENTOR(S) : John R. Warren

It is certified that error appears in the above-identified patent and that said Letters Patent is hereby corrected as shown below:

In column 3, line 59, delete the word "substrate" and substitute the word --subsurface-- therefor.

Signed and Sealed this

Twenty-second Day of January, 1991

*Attest:*

HARRY F. MANBECK, JR.

*Attesting Officer*

*Commissioner of Patents and Trademarks*